US008668789B2

(12) United States Patent
Hirasawa et al.

(10) Patent No.: US 8,668,789 B2
(45) Date of Patent: Mar. 11, 2014

(54) METHOD FOR MANUFACTURING OF HIGH STRENGTH COLD ROLLED STEEL SHEET OF EXCELLENT PHOSPHATABILITY

(75) Inventors: Junichiro Hirasawa, Chiba (JP); Naoto Yoshimi, Hiroshima (JP); Hiroki Nakamaru, Chiba (JP); Kohei Hasegawa, Hiroshima (JP); Hideyuki Tsurumaru, Hiroshima (JP); Keita Yonetsu, Okayama (JP); Hideyuki Takahashi, Hiroshima (JP); Masato Sasaki, Hiroshima (JP)

(73) Assignee: JFE Steel Corporation, Tokyo (JP)

( * ) Notice: Subject to any disclaimer, the term of this patent is extended or adjusted under 35 U.S.C. 154(b) by 157 days.

(21) Appl. No.: 13/387,761

(22) PCT Filed: Jul. 27, 2010

(86) PCT No.: PCT/JP2010/062984

§ 371 (c)(1),
(2), (4) Date: Apr. 9, 2012

(87) PCT Pub. No.: WO2011/013837

PCT Pub. Date: Feb. 3, 2011

(65) Prior Publication Data

US 2012/0186707 A1 Jul. 26, 2012

(30) Foreign Application Priority Data

Jul. 29, 2009 (JP) ..... 2009-176115

(51) Int. Cl.
*C21D 6/00* (2006.01)
*C21D 1/52* (2006.01)
*C21D 1/26* (2006.01)

(52) U.S. Cl.
USPC ..... 148/661; 148/579; 148/625; 148/633; 148/634; 148/660

(58) Field of Classification Search
USPC ..... 148/284, 579, 660, 661, 625, 633, 634
See application file for complete search history.

(56) References Cited

U.S. PATENT DOCUMENTS

| | | | | |
|---|---|---|---|---|
| 2012/0325376 | A1* | 12/2012 | Makimizu et al. | 148/284 |
| 2013/0048157 | A1* | 2/2013 | Ootsuka et al. | 148/579 |

FOREIGN PATENT DOCUMENTS

| | | | |
|---|---|---|---|
| JP | 07-41923 | * | 2/1995 |
| JP | 08-269662 | * | 10/1996 |
| JP | 10-147838 | | 6/1998 |
| JP | 2004-010991 | | 1/2004 |
| JP | 2004-018911 | | 1/2004 |
| JP | 2005-154872 | | 6/2005 |
| JP | 2006-045615 | | 2/2006 |
| JP | 2007-138262 | | 6/2007 |

OTHER PUBLICATIONS

International Search Report—PCT/2010/062984—Oct. 26, 2010.

* cited by examiner

*Primary Examiner* — Deborah Yee
(74) *Attorney, Agent, or Firm* — Young & Thompson

(57) ABSTRACT

A method for the manufacturing of high strength cold rolled steel sheets includes continuously annealing a cold rolled steel sheet that has a composition containing C: 0.05-0.3% mass, Si: 0.6-3.0% mass, Mn: 1.0-3.0% mass, P: ≤0.1% mass, S: ≤0.02% mass, Al: 0.01-1% mass, N: ≤0.01% mass, and Fe and inevitable impurities: balance, in a manner such that the cold rolled steel sheet is heated in a furnace using an oxidizing burner to a steel sheet temperature of ≥700° C., then soak-annealed in a reducing atmosphere furnace at 750-900° C., then cooled so the average cooling rate between 500° C. and 100° C. is ≥50° C./s. High-Si cold rolled steel sheets with high strength and good phosphatability while containing Si≥0.6% are obtained without controlling conditions so as to increase the dew point in the reducing atmosphere in the soaking furnace or to increase the vapor hydrogen partial pressure ratio.

20 Claims, No Drawings

METHOD FOR MANUFACTURING OF HIGH STRENGTH COLD ROLLED STEEL SHEET OF EXCELLENT PHOSPHATABILITY

TECHNICAL FIELD

The present invention relates to methods for the manufacturing of automotive high strength cold rolled steel sheets that will be subjected to chemical conversion treatment such as phosphatization before use. In particular, the methods according to the invention are suitable for the manufacturing of high-Si, high strength cold rolled steel sheets that have a tensile strength of not less than 590 MPa due to the strengthening effect of Si and have excellent processability with TS×El being not less than 18000 MPa·%.

BACKGROUND ART

The weight reduction of automobiles has recently increased demands for cold rolled steel sheets having high strength and excellent processability. An automotive cold rolled steel sheet is painted before the use thereof. Prior to the painting, the steel sheet is subjected to a chemical conversion treatment called phosphatization. Phosphatability is one of the important characteristics of cold rolled steel sheets in order to ensure adhesion of a paint as well as corrosion resistance.

Regarding the production of high strength cold rolled steel sheets, PTL 1 discloses a method for producing dual phase high tensile strength cold rolled steel sheets containing Si at 0.80 to 1.5% by mass and having a tensile strength of as high as 980 MPa.

High-Si cold rolled steel sheets achieve high strength and good processability due to the strengthening effect of Si. However, silicon oxide is formed on the outermost surface during continuous annealing that is generally carried out in a $N_2$+$H_2$ gas atmosphere to prevent oxidation of iron (Fe). It is known that the silicon oxide layer inhibits the formation of a chemical conversion layer and the phosphatability is deteriorated.

Regarding techniques for improving the phosphatability of high-Si cold rolled steel sheets, PTL 2 discloses a method for manufacturing cold rolled steel sheets containing, in terms of % by mass, Si at not less than 0.1% and/or Mn at not less than 1.0%, which method includes forming an oxide layer on the surface of a steel sheet at a steel sheet temperature of not less than 400° C. in an iron oxidizing atmosphere, and thereafter reducing the oxide layer on the surface of the steel sheet in an iron reducing atmosphere.

CITATION LIST

Patent Literature

PTL 1: Japanese Patent No. 3478128

PTL 2: Japanese Unexamined Patent Application Publication No. 2006-45615

SUMMARY OF INVENTION

Technical Problem

According to the method disclosed in PTL 1, the steel sheet is held at a soaking temperature in a continuous annealing step in a furnace in which the atmosphere is usually a $N_2$+$H_2$ gas atmosphere which does not induce oxidation of iron (Fe). However, this atmosphere does not prevent silicon from being oxidized. That is, Si contained at 0.8 to 1.5% by mass forms an oxide ($SiO_2$) on the outermost surface of the steel sheet, and the oxide remains on the final product to deteriorate the phosphatability.

According to the method of PTL 2, Fe on the surface of the steel sheet is oxidized at 400° C. or above and thereafter the steel sheet is annealed in a $N_2$+$H_2$ gas atmosphere which reduces the Fe oxide. That is, the layer formed on the outermost surface is not $SiO_2$ which deteriorates the phosphatability but is a reduced Fe layer. However, when the steel sheet contains Si at 0.6% or more and the oxidation is carried out at low temperatures ranging from 400° C. to 550° C., Fe is not sufficiently oxidized due to the high effects of Si to suppress the oxidation of Fe. As a result, the formation of a reduced Fe layer on the outermost surface becomes insufficient, and the Si oxide remains on the surface of the steel sheet after the reduction to possibly deteriorate the phosphatability. Further, PTL 2 evaluates the phosphatability based only on the amount of attached phosphate. However, a study by the present inventors has revealed that not only the amount of attached phosphate but the ratio of the phosphate layer covering the steel sheet surface are influential on the adhesion of a paint and the corrosion resistance.

The present invention is aimed at solving the problems described above. It is therefore an object of the invention to provide methods for the manufacturing of high strength cold rolled steel sheets that have excellent phosphatability while containing Si at 0.6% or more.

Solution to Problem

The present invention solves the aforementioned problems by providing the following.

[1] A method for the manufacturing of high strength cold rolled steel sheets of excellent phosphatability, including continuously annealing a cold rolled steel sheet that has a composition containing:

C: 0.05 to 0.3% by mass,
Si: 0.6 to 3.0% by mass,
Mn: 1.0 to 3.0% by mass,
P: not more than 0.1% by mass,
S: not more than 0.02% by mass,
Al: 0.01 to 1% by mass,
N: not more than 0.01% by mass, and
Fe and inevitable impurities: balance, in a manner such that the cold rolled steel sheet is heated in a furnace using an oxidizing burner to a steel sheet temperature of not less than 700° C., thereafter the steel sheet is soak-annealed in a reducing atmosphere furnace at 750 to 900° C., and the steel sheet is cooled in a manner such that the average cooling rate between 500° C. and 100° C. is not less than 50° C./s.

[2] A method for the manufacturing of high strength cold rolled steel sheets of excellent phosphatability, including continuously annealing a cold rolled steel sheet that has a composition containing:

C: 0.05 to 0.3% by mass,
Si: 0.6 to 3.0% by mass,
Mn: 1.0 to 3.0% by mass,
P: not more than 0.1% by mass,
S: not more than 0.02% by mass,
Al: 0.01 to 1% by mass,
N: not more than 0.01% by mass, and
Fe and inevitable impurities: balance, in a manner such that the cold rolled steel sheet is heated to a steel sheet temperature of not less than 700° C. in a manner such that the steel sheet is heated in a furnace using an oxidizing burner at least when the steel sheet temperature is elevated from 600° C. to 700° C., thereafter the steel sheet is soak-annealed in a reducing atmosphere furnace at 750 to 900° C., and the steel sheet is cooled in a manner such that the average cooling rate between 500° C. and 100° C. is not less than 50° C./s.

[3] A method for the manufacturing of high strength cold rolled steel sheets of excellent phosphatability, including continuously annealing a cold rolled steel sheet that has a composition containing:

C: 0.05 to 0.3% by mass,

Si: 0.6 to 3.0% by mass,

Mn: 1.0 to 3.0% by mass,

P: not more than 0.1% by mass,

S: not more than 0.02% by mass,

Al: 0.01 to 1% by mass,

N: not more than 0.01% by mass, and

Fe and inevitable impurities: balance, in a manner such that the cold rolled steel sheet is heated in a manner such that the steel sheet is heated in a furnace using an oxidizing burner at least from before the steel sheet temperature reaches 550° C. and further heated to a steel sheet temperature of not less than 750° C. in a furnace using a direct flame burner that is located after the oxidizing burner and has an air ratio of not more than 0.89, thereafter the steel sheet is soak-annealed in a reducing atmosphere furnace at 750 to 900° C., and the steel sheet is cooled in a manner such that the average cooling rate between 500° C. and 100° C. is not less than 50° C./s.

[4] The method for the manufacturing of high strength cold rolled steel sheets of excellent phosphatability according to any one of [1] to [3], wherein the steel sheet further contains one or two or more of:

Ti: 0.001 to 0.1% by mass,

Nb: 0.001 to 0.1% by mass, and

V: 0.001 to 0.1% by mass.

[5] The method for the manufacturing of high strength cold rolled steel sheets of excellent phosphatability according to any one of [1] to [4], wherein the steel sheet further contains one or two of:

Mo: 0.01 to 0.5% by mass, and

Cr: 0.01 to 1% by mass.

[6] The method for the manufacturing of high strength cold rolled steel sheets of excellent phosphatability according to any one of [1] to [5], wherein the steel sheet further contains:

B: 0.0001 to 0.003% by mass.

[7] The method for the manufacturing of high strength cold rolled steel sheets of excellent phosphatability according to any one of [1] to [6], wherein the steel sheet further contains one or two of:

Cu: 0.01 to 0.5% by mass, and

Ni: 0.01 to 0.5% by mass.

[8] The method for the manufacturing of high strength cold rolled steel sheets of excellent phosphatability according to any one of [1] to [7], wherein after the cooling step described in any one of [1] to [3], the steel sheet is reheated to 150 to 450° C. and soak-heat treated at the temperature for 1 to 30 minutes.

Advantageous Effects of Invention

According to the present invention, Fe on the surface of a high strength cold rolled steel sheet containing Si at 0.6% or more is oxidized and thereafter reduced to confine the Si oxide inside the steel sheet. The resultant high-Si cold rolled steel sheet achieves improved phosphatability as well as a high tensile strength of not less than 590 MPa and excellent processability with TS×El being not less than 18000 MPa·%. According to the inventive methods, it is not necessary to control the annealing atmosphere (in particular, controlling the dew point high). The inventive methods are thus advantageous in terms of operation controlling properties. Further, the inventive methods remedy the problems such as quick degradation of furnace walls or furnace rolls, and generation of scale defects or otherwise called pickups on the surface of the steel sheets.

DESCRIPTION OF EMBODIMENTS

Hereinbelow, there will be described the reason why the chemical composition of the steel sheet used in the invention is limited. The percentages [%] regarding the composition refer to % by mass unless otherwise mentioned.

Si: 0.6 to 3.0%

Silicon is an element that increases the strength without a marked decrease in processability of a steel sheet. In order to obtain a high strength cold rolled steel sheet, Si is contained at 0.6% or more. To obtain good processability, Si is preferably contained at 0.8% or more, and more preferably in excess of 1.10%. The upper limit is 3.0%, above which the steel sheet becomes very brittle.

C: 0.05 to 0.3%

In order to control the metal phase to a ferrite-martensite phase and to obtain a desired quality of the material, carbon is contained at 0.05 to 0.3%, preferably not less than 0.07%, and more preferably not less than 0.10%.

Mn: 1.0 to 3.0%

Manganese is an important element for inhibiting the formation of ferrite in a gradual cooling zone in a continuous annealing furnace. The inhibitory effect is insufficient if the manganese content is less than 1.0%. The Mn content is preferably not less than 1.5%. If the content is in excess of 3.0%, the slab cracks during a continuous casting step. The Mn content is therefore controlled to be in the range of 1.0 to 3.0%.

P: Not More than 0.1%

Phosphorus is an impurity in the steel in the present invention. Because phosphorus decreases spot weldability, it is desirable that as much as possible phosphorus be removed during steelmaking steps. If the P content is in excess of 0.1%, the spot weldability is markedly deteriorated. Thus, the P content should be not more than 0.1%.

S: Not More than 0.02%

Sulfur is an impurity in the steel in the present invention. Because sulfur decreases spot weldability, it is desirable that as much as possible sulfur be removed during steelmaking steps. If the S content is in excess of 0.02%, the spot weldability is markedly deteriorated. Thus, the S content should be not more than 0.02%. To achieve good processability, the S content is more preferably not more than 0.002%.

Al: 0.01 to 1%

Aluminum is added for the purposes of deoxidation and precipitating nitrogen as AlN. If Al is added at less than 0.01%, sufficient effects cannot be obtained in deoxidation and denitrification. Adding aluminum in an amount exceeding 1% is not economical because the effects are saturated. Thus, the Al content is controlled to be in the range of 0.01 to 1%.

N: Not More than 0.01%

Nitrogen is an impurity that is present in crude steel and decreases shaping properties of the material steel sheet. It is therefore desirable that as much as possible nitrogen be removed and the N content be reduced to the least level during steelmaking steps. However, removing nitrogen more than necessary increases refining costs. Thus, the N content is controlled to be not more than 0.01%, at which substantially no problems are caused.

Further, one or more of the following components may be added as required.

One or Two or More of Ti: 0.001 to 0.1%, Nb: 0.001 to 0.1% and V: 0.001 to 0.1%

Titanium, niobium and vanadium may be added as required because they are effective in increasing the strength by forming carbides and nitrides. When they are added, amounts of less than 0.001% do not provide sufficient effects. On the other hand, adding these elements each in excess of 0.1% results in a marked decrease in processability. Therefore, the addition amount of each of these elements is controlled to be in the range of 0.001 to 0.1%.

One or two of Mo: 0.01 to 0.5% and Cr: 0.01 to 1%

Molybdenum and chromium may be added as required because they are effective in increasing the strength by inhibiting the formation of ferrite and bainite during cooling in the continuous annealing step. When they are added, amounts of less than 0.01% each do not provide sufficient effects. On the other hand, adding Mo in excess of 0.5% or Cr in excess of 1% results in a marked decrease in processability. Therefore, the addition amounts of these elements are controlled to be in the range of 0.01 to 0.5% for molybdenum and 0.01 to 1% for chromium.

B: 0.0001 to 0.003%

Boron may be added as required. When the steel sheet is used as a machinery structural member such as an automotive skeleton part, boron contributes to an increase of strength that is exhibited when the steel sheet is pressed or bake finished. The addition does not provide sufficient effects when the amount is less than 0.0001%. Adding boron in excess of 0.003% results in a marked decrease in processability. Therefore, the addition amount is controlled to be in the range of 0.0001 to 0.003%.

One or two of Cu: 0.01 to 0.5% and Ni: 0.01 to 0.5%

Copper and nickel may be added as required in order to increase the strength and to inhibit corrosion during the use of the steel sheet. The addition does not provide sufficient effects when the amounts are each less than 0.01%. Adding these elements each in excess of 0.5% results in a decrease in processability as well as in yield due to the embrittlement of the steel in the manufacturing steps such as a hot rolling step. Therefore, the addition amounts are each controlled to be in the range of 0.01 to 0.5%.

The balance after the deduction of the above elements is represented by Fe and inevitable impurities.

Next, the manufacturing methods will be described.

The steel having the aforementioned composition is hot rolled, subsequently pickled and cold rolled. Thereafter, the cold rolled steel is continuously annealed on a continuous annealing line. The procedures before the continuous annealing, namely, the process for the manufacturing of the cold rolled steel sheet, is not particularly limited and a known process may be used.

In the continuous annealing line, three steps of temperature increasing, soaking and cooling are continuously carried out.

In the temperature increasing step, the steel sheet at room temperature is heated in a heating furnace using oxidizing burners to a steel sheet temperature of not less than 700° C., preferably not less than 760° C. As a result of the heating, Fe oxide is formed on the surface of the steel sheet. From the viewpoint of the formation of Fe oxide, it is preferable that the temperature be increased to as high a temperature as possible. However, excessive oxidation should be avoided because the Fe oxide falls or separates in a subsequent reducing atmosphere furnace and causes pickup defects. Accordingly, the temperature is preferably increased to not more than 800° C.

Herein, the oxidizing burner is a direct flame burner which heats a steel sheet by applying directly to the surface of the steel sheet a burner flame that is produced by burning a mixture of air and a fuel such as coke oven gas (COG) by-produced in a steelmaking plant, and in which the air ratio is increased enough to promote the oxidation of the steel sheet that is heated.

In most cases of the continuous annealing line, the heating furnace has direct flame burners. For the direct flame burners to work as oxidizing burners, the air ratio in the direct flame burners should be 0.95 or more. The air ratio is preferably 1.00 or more, and more preferably 1.10 or more. The higher the air ratio, the higher the oxidizing power. Thus, from the viewpoint of the formation of Fe oxide, it is preferable that the air ratio be as high as possible. However, excessive oxidation should be avoided because the Fe oxide falls or separates in a subsequent reducing atmosphere furnace and causes pickup defects. Accordingly, the air ratio is preferably not more than 1.3.

Examples of the fuels used in the direct flame burners include COG and liquefied natural gas (LNG).

In the case where a preheating furnace is provided before the heating furnace, the steel sheet at room temperature is heated in the preheating furnace to a steel sheet temperature of less than 600° C., and subsequently the steel sheet is heated in the heating furnace using the oxidizing burners at least from 600° C. to a steel sheet temperature of not less than 700° C. The atmosphere in the preheating furnace is not particularly limited. The preheating furnace usually utilizes residual heat of a high temperature atmosphere gas generated in the furnace. Thus, the atmosphere in the preheating furnace may be an exhaust gas from, for example, the direct flame heating zone. When the temperature of the steel sheet heated in the preheating furnace is less than 550° C., the surface of the steel sheet is not substantially oxidized and thus the atmosphere in the furnace around this temperature hardly influences the phosphatability of the product. On the other hand, Fe oxide is markedly formed on the surface of the steel sheet at a temperature of 600° C. or above. Therefore, in order to take advantage of the mechanism of improvement in phosphatability utilizing oxidation and subsequent reduction of Fe according to the finding of the present invention, it is necessary that heating be performed using the oxidizing burners at least in the range of temperatures from 600° C. to 700° C. To increase the effects by heating, the temperature is preferably raised to 760° C. or above. However, excessive oxidation should be avoided because the Fe oxide falls or separates in a subsequent reducing atmosphere furnace and causes pickup defects. Accordingly, the steel sheet is preferably heated with the oxidizing burners to a steel sheet temperature of not more than 800° C.

In order to prevent pickup defects due to the separation of Fe oxide, the heating furnace having direct flame burners is often operated in a manner such that the burners in the former stage in the heating furnace are used as oxidizing burners, and the air ratio in the latter stage in the heating furnace is controlled to be not more than 0.89 for the burners to be used as direct flame burners. Little or no oxidation takes place during heating with the burners at an air ratio of not more than 0.89. Accordingly, in the above case, heating with the oxidizing burners is initiated before the steel sheet temperature reaches at least 550° C. in order to increase the amount of Fe oxide produced in the heating furnace. That is, the steel sheet is being heated in the furnace using the oxidizing burners after the steel sheet temperature reaches at least 550° C., preferably while the temperature is between 550° C. and 700° C., to form Fe oxide on the surface of the steel sheet, and thereafter the steel sheet is heated in the furnace using the direct flame burners at an air ratio of not more than 0.89 to a steel sheet temperature of not less than 750° C., and preferably not less than 760° C. Because excessive oxidation results in falling or separation of the Fe oxide in a subsequent reducing atmosphere furnace and consequent pickup defects, the steel sheet is preferably heated with the direct flame burners at an air ratio of not more than 0.89 to a steel sheet temperature of not more than 800° C.

The reducing atmosphere furnace after the heating with the oxidizing burners is a furnace equipped with a radiant tube burner. The atmosphere gas that is introduced into the furnace is preferably a mixture of $H_2$ (1 to 10% by volume) and the balance of $N_2$. If the volume of $H_2$ is less than 1%, the amount of $H_2$ is insufficient to reduce the Fe oxide on the surface of the steel sheet that is continuously passed through the furnace. With a hydrogen volume of above 10%, the reduction of Fe oxide is saturated and the excess $H_2$ is wasted. If the dew point is above −25° C., marked oxidation with oxygen of $H_2O$ in the furnace occurs resulting in excessive internal oxidation of Si. Accordingly, the dew point is preferably not more than −25° C. Under these conditions, the atmosphere in the soaking furnace becomes reductive for Fe and the Fe oxide formed in the heating furnace is reduced. At this time, part of the oxygen atoms separated from Fe by the reduction diffuse into the steel sheet and react with Si to form the internal oxide $SiO_2$. Because Si is oxidized inside the steel sheet and the amount of Si oxide on the outermost surface of the steel sheet on which the chemical conversion reaction takes place is reduced, the outermost surface of the steel sheet achieves good phosphatability.

The soak-annealing is performed at a steel sheet temperature in the range of 750° C. to 900° C. The soaking time is preferably 10 seconds to 10 minutes. After the soak-annealing, the steel sheet is cooled to a temperature of 100° C. or below by means of, for example, gas, mist quench (mist) or water in a manner such that the average cooling rate between 500° C. and 100° C. is not less than 50° C./s. To further improve processability (TS×El), a tempering treatment may be performed thereafter as required in which the metal sheet is soaked at 150° C. to 450° C. for 1 to 30 minutes. After the cooling or the tempering treatment, the steel sheet may be pickled with, for example, hydrochloric acid or sulfuric acid to remove oxides and other unwanted matters on the surface.

To promote the formation of phosphate crystal during the phosphatization and to achieve improved phosphatability, the surface of the steel sheet may be coated with Ni in an amount of deposited Ni of 5 mg/m$^2$ to 100 mg/m$^2$.

EXAMPLE 1

Steels A to N that had the chemical compositions shown in Table 1 were each hot rolled, pickled and cold rolled by ordinary methods to give steel sheets 1.5 mm in thickness. The steel sheets were each annealed by being passed through a continuous annealing line which had a heating furnace equipped with direct flame burners, a radiant tube type soaking furnace and a cooling furnace, thereby manufacturing high strength cold rolled steel sheets. Carbon gas was used as the fuel in the direct flame burners, and the air ratio was changed to various values. Table 2 describes the conditions in the heating furnace and those in the soaking furnace. After the soak-annealing, the steel sheet was cooled to not more than 100° C. by means of water, mist quench (mist) or gas at a cooling rate shown in Table 2. The holding temperature and the holding time described in Table 2 indicate that the steel sheet cooled to not more than 100° C. was reheated to the holding temperature and held for the time described in Table 2. Further, the steel sheets were pickled with the acid described in Table 2 or were directly obtained as products.

The pickling conditions were as follows.

Pickling with hydrochloric acid: acid concentration 1 to 20%, liquid temperature 30 to 90° C., pickling time 5 to 30 sec Pickling with sulfuric acid: acid concentration 1 to 20%, liquid temperature 30 to 90° C., pickling time 5 to 30 sec The high strength cold rolled steel sheets were evaluated with respect to phosphatability, surface appearance and mechanical properties. The methods for the evaluation of phosphatability, surface appearance and mechanical properties are described below.

(1) Phosphatability

The steel sheet was phosphated as described below using a phosphatization liquid (PALBOND (PB) L3080 (registered trademark)) manufactured by Nihon Parkerizing Co., Ltd.

The steel sheet was degreased with degreasing liquid FINE CLEANER (registered trademark) manufactured by Nihon Parkerizing Co., Ltd., and was thereafter washed with water. Subsequently, the surface of the steel sheet was conditioned for 30 seconds with surface conditioning liquid PREPAREN Z (registered trademark) manufactured by Nihon Parkerizing Co., Ltd. The steel sheet was then soaked in the phosphatization liquid (PALBOND (PB) L3080) at 43° C. for 120 seconds, washed with water and dried with hot air.

The phosphate layer was observed with a scanning electron microscope (SEM) at ×500 magnification with respect to five fields of view that were randomly selected. The none covered area ratio of the phosphate layer was measured by image processing. The following evaluation was made on the basis of the none covered area ratio. The symbols ○ and ⊙ indicate acceptable levels. The term "none covered area" refers to the area where phosphate crystal is NOT formed. The none covered area ratio is obtained from (none covered area)/(observed area).

⊙: not more than 5%

○: more than 5% to not more than 10% x : more than 10% (2) Mechanical Properties

A JIS No. 5 test piece (JIS Z 2201) was sampled from the steel sheet along a direction that was perpendicular to the rolling direction. The test piece was tested in accordance with JIS Z 2241 to evaluate mechanical properties. To evaluate the strength after bake finishing, the test piece was preliminarily strained 5%, held at 170° C. for 20 minutes and stretched to determine the tensile strength ($TS_{BH}$). This tensile strength was compared with the initial tensile strength ($TS_0$), and the difference was defined as ΔTS ($TS_{BH}$−$TS_0$). The processability was evaluated based on the value obtained by tensile strength TS×elongation (El). The samples that gave a TS×El value of 18000 MPa·% or more were evaluated to be excellent in processability.

Table 2 shows the steels used in this EXAMPLE, the manufacturing conditions in the continuous annealing line and the evaluation results.

TABLE 1 unit: mass %

| Steel symbol | C | Si | Mn | P | S | Al | N | Ti | Nb | V | Cr | Mo | Cu | Ni | B |
|---|---|---|---|---|---|---|---|---|---|---|---|---|---|---|---|
| A | 0.12 | 1.43 | 1.9 | 0.02 | 0.003 | 0.01 | 0.004 | | | | | | | | |
| B | 0.08 | 1.62 | 2.5 | 0.01 | 0.002 | 0.03 | 0.003 | 0.03 | | | | | | | 0.0013 |
| C | 0.15 | 0.85 | 1.6 | 0.02 | 0.005 | 0.02 | 0.005 | | 0.05 | | 0.35 | | | | |
| D | 0.05 | 0.56 | 1.1 | 0.03 | 0.001 | 0.05 | 0.004 | 0.01 | | 0.05 | | 0.12 | | | |
| E | 0.20 | 1.51 | 2.5 | 0.02 | 0.002 | 0.01 | 0.007 | 0.05 | | | 0.01 | 0.01 | | | 0.0033 |

TABLE 1-continued unit: mass %

| Steel symbol | C | Si | Mn | P | S | Al | N | Ti | Nb | V | Cr | Mo | Cu | Ni | B |
|---|---|---|---|---|---|---|---|---|---|---|---|---|---|---|---|
| F | 0.10 | 1.15 | 2.1 | 0.03 | 0.015 | 0.03 | 0.004 | | 0.005 | 0.01 | | | | | 0.0003 |
| G | 0.04 | 1.20 | 1.2 | 0.01 | 0.002 | 0.03 | 0.005 | | | | | | | | |
| H | 0.25 | 1.30 | 2.9 | 0.02 | 0.003 | 0.04 | 0.003 | | | | | | | | |
| I | 0.15 | 0.40 | 1.6 | 0.02 | 0.001 | 0.03 | 0.003 | | 0.02 | | | | | | |
| J | 0.09 | 2.89 | 1.8 | 0.01 | 0.002 | 0.45 | 0.002 | | | | | | 0.4 | 0.2 | |
| K | 0.08 | 3.15 | 1.6 | 0.03 | 0.004 | 0.04 | 0.003 | | | | | | | | |
| L | 0.06 | 1.80 | 0.9 | 0.02 | 0.004 | 0.03 | 0.003 | | | | | | | | 0.0005 |
| M | 0.13 | 2.60 | 3.1 | 0.01 | 0.003 | 0.05 | 0.005 | | | | | | | | |
| N | 0.12 | 1.30 | 2.0 | 0.01 | 0.002 | 0.03 | 0.004 | | | | | | | | 0.0008 |

TABLE 2

| | | Heating with furnace having direct flame burners | | | Conditions in reducing atmosphere annealing, cooling and reheating | | | | | | | |
|---|---|---|---|---|---|---|---|---|---|---|---|---|
| No. | Steel symbol | Air ratio | Oxidizing burners | Temperature on furnace exit side (° C.) | Hydrogen concentration (% by volume) | Dew point (° C.) | Soaking temperature (° C.) | Soaking time (sec) | Cooling conditions | Cooling rate (° C./sec) | Holding temperature (° C.) | Holding time (sec) |
| 1 | A | 1.00 | ○ | 700 | 6% | −28 | 830 | 30 | Water | >1000 | — | — |
| 2 | A | 0.95 | ○ | 730 | 1% | −35 | 830 | 30 | Water | >1000 | — | — |
| 3 | A | 1.25 | ○ | 800 | 3% | −40 | 830 | 540 | Water | >1000 | 310 | 290 |
| 4 | A | 0.85 | X | 700 | 6% | −42 | 830 | 30 | Water | >1000 | 350 | 90 |
| 5 | A | 1.00 | ○ | 460 | 6% | −45 | 830 | 30 | Water | >1000 | 220 | 250 |
| 6 | B | 1.20 | ○ | 800 | 7% | −38 | 820 | 20 | Gas | 100 | 320 | 650 |
| 7 | B | 1.00 | ○ | 700 | 7% | −38 | 820 | 20 | Gas | 100 | — | — |
| 8 | C | 1.10 | ○ | 760 | 5% | −30 | 800 | 60 | Mist quench | 500 | 360 | 670 |
| 9 | C | 1.20 | ○ | 780 | 5% | −30 | 800 | 60 | Mist quench | 500 | — | — |
| 10 | D | 0.96 | ○ | 700 | 3% | −25 | 800 | 120 | Water | >1000 | 240 | 900 |
| 11 | E | 1.10 | ○ | 770 | 10% | −45 | 800 | 100 | Gas | 60 | — | — |
| 12 | F | 1.05 | ○ | 760 | 7% | −35 | 850 | 120 | Mist quench | 500 | 150 | 460 |
| 13 | F | 1.15 | ○ | 650 | 7% | −38 | 820 | 20 | Mist quench | 500 | 360 | 330 |
| 14 | G | 1.00 | ○ | 800 | 6% | −42 | 830 | 20 | Water | >1000 | 370 | 450 |
| 15 | H | 0.95 | ○ | 700 | 6% | −42 | 780 | 60 | Gas | 60 | 180 | 100 |
| 16 | I | 0.85 | X | 760 | 7% | −38 | 830 | 90 | Gas | 100 | 290 | 950 |
| 17 | J | 1.00 | ○ | 780 | 7% | −38 | 890 | 100 | Water | >1000 | 330 | 570 |
| 18 | K | 1.20 | ○ | 700 | 5% | −30 | 820 | 140 | Water | >1000 | 320 | 750 |
| 19 | L | 1.00 | ○ | 770 | 5% | −30 | 750 | 50 | Water | >1000 | 260 | 620 |
| 20 | M | 1.10 | ○ | 760 | 3% | −25 | 800 | 120 | Gas | 100 | 350 | 140 |
| 21 | N | 1.20 | ○ | 730 | 10% | −45 | 780 | 50 | Water | >1000 | 210 | 140 |
| 22 | D | 0.87 | X | 800 | 7% | −35 | 750 | 40 | Water | >1000 | 340 | 370 |
| 23 | B | 1.00 | ○ | 700 | 7% | −38 | 820 | 20 | Gas | 30 | — | — |

| | | Mechanical properties | | | | | None covered area ratio | |
|---|---|---|---|---|---|---|---|---|
| No. | Pickling | YS (MPa) | TS (MPa) | EI % | TS × EI (Mpa · %) | Δ TS (MPa) | of phosphate layer | |
| 1 | Hydrochloric acid | 810 | 1020 | 18.2 | 18600 | 20 | ○ | Inventive |
| 2 | Sulfuric acid | 800 | 1010 | 18.9 | 19120 | 0 | ○ | Inventive |
| 3 | Hydrochloric acid | 810 | 1020 | 18.5 | 18820 | 40 | ◎ | Inventive |
| 4 | Sulfuric acid | 820 | 1030 | 18.7 | 19230 | 40 | X | Comparative |
| 5 | — | 840 | 1050 | 18.5 | 19470 | 40 | X | Comparative |
| 6 | — | 670 | 840 | 23.0 | 19360 | 10 | ◎ | Inventive |
| 7 | Hydrochloric acid | 680 | 860 | 22.5 | 19390 | 20 | ○ | Inventive |
| 8 | — | 830 | 1040 | 17.5 | 18250 | 40 | ◎ | Inventive |
| 9 | Hydrochloric acid | 800 | 1000 | 19.6 | 19570 | 10 | ◎ | Inventive |
| 10 | Sulfuric acid | 600 | 750 | 26.5 | 19910 | 30 | ○ | Inventive |
| 11 | — | 1000 | 1250 | 15.5 | 19430 | 40 | ◎ | Inventive |
| 12 | Hydrochloric acid | 790 | 990 | 19.0 | 18830 | 10 | ◎ | Inventive |
| 13 | Sulfuric acid | 820 | 1035 | 17.9 | 18500 | 0 | X | Comparative |
| 14 | — | 420 | 530 | 34.5 | 18260 | 10 | ◎ | Comparative |
| 15 | — | 1200 | 1500 | 12.2 | 18290 | 30 | ○ | Inventive |

TABLE 2-continued

| | | | | | | | | |
|---|---|---|---|---|---|---|---|---|
| 16 | Hydrochloric acid | 800 | 1000 | 14.3 | 14300 | 30 | ○ | Comparative |
| 17 | Hydrochloric acid | 680 | 850 | 25.0 | 21250 | 0 | ○ | Inventive |
| 18 | Sulfuric acid | 680 | 860 | 24.5 | 21070 | 10 | X | Comparative |
| 19 | Sulfuric acid | 430 | 490 | 39.0 | 19110 | 40 | ◎ | Comparative |
| 20 | — | 1150 | 1350 | 8.4 | 11340 | 40 | ○ | Comparative |
| 21 | Hydrochloric acid | 800 | 1010 | 19.5 | 19740 | 120 | ○ | Inventive |
| 22 | Sulfuric acid | 820 | 1030 | 18.4 | 18980 | 10 | X | Comparative |
| 23 | Hydrochloric acid | 360 | 550 | 35.0 | 19250 | 20 | ○ | Comparative |

The steel sheets obtained in the inventive examples achieved a tensile strength (TS) of not less than 590 MPa and excellent processability with TS×El>18000, and showed good phosphatability. The steel sheets in the comparative examples were inferior in any of tensile strength, processability and phosphatability.

EXAMPLE 2

The steels A to F that had the chemical compositions shown in Table 1 were each hot rolled, pickled and cold rolled by ordinary methods to give steel sheets 1.5 mm in thickness. The steel sheets were each annealed by being passed through a continuous annealing line which had a preheating furnace, a heating furnace equipped with direct flame burners, a radiant tube type soaking furnace and a cooling furnace, thereby manufacturing high strength cold rolled steel sheets. Carbon gas was used as the fuel in the direct flame burners, and the air ratio was changed to various values. Table 3 describes the conditions in the heating furnace and those in the soaking furnace. After the soak-annealing, the steel sheet was cooled to not more than 100° C. by means of water, mist quench or gas at a cooling rate shown in Table 3. The holding temperature and the holding time described in Table 3 indicate that the steel sheet cooled to not more than 100° C. was reheated to the holding temperature and held for the time described in Table 3. Further, the steel sheets were pickled with the acid described in Table 3 or were directly obtained as products.

The pickling conditions were the same as those described in EXAMPLE 1.

The high strength cold rolled steel sheets were evaluated with respect to mechanical properties and phosphatability. The methods for the evaluation of mechanical properties and phosphatability were the same as those described in EXAMPLE 1.

Table 3 shows the steels used in this EXAMPLE, the manufacturing conditions in the continuous annealing line and the evaluation results.

TABLE 3

| | | | Heating with furnace having direct flame burners | | | Conditions in reducing atmosphere annealing, cooling and reheating | | | | | | | |
|---|---|---|---|---|---|---|---|---|---|---|---|---|---|
| No. | Steel symbol | Finish preheating temperature (° C.) | Air ratio | Oxidizing burners | Temperature on furnace exit side (° C.) | Hydrogen concentration (% by volume) | Dew point (° C.) | Soaking temperature (° C.) | Soaking time (sec) | Cooling conditions | Cooling rate (° C./sec) | Holding temperature (° C.) | Holding time (° C.) |
| 1 | A | 400 | 1.00 | ○ | 700 | 6% | −28 | 890 | 30 | Water | >1000 | — | — |
| 2 | A | 550 | 0.95 | ○ | 730 | 1% | −35 | 860 | 30 | Water | >1000 | — | — |
| 3 | A | 200 | 1.25 | ○ | 760 | 3% | −40 | 830 | 540 | Water | >1000 | 320 | 540 |
| 4 | A | 620 | 0.95 | ○ | 700 | 6% | −42 | 830 | 30 | Water | >1000 | 380 | 100 |
| 5 | A | 250 | 1.00 | ○ | 480 | 6% | −45 | 830 | 30 | Water | >1000 | 250 | 590 |
| 6 | A | 500 | 0.82 | X | 700 | 10% | −45 | 830 | 30 | Water | >1000 | 390 | 440 |
| 7 | B | 450 | 1.20 | ○ | 780 | 8% | −40 | 820 | 30 | Gas | 100 | 350 | 430 |
| 8 | C | 500 | 1.00 | ○ | 700 | 7% | −38 | 820 | 20 | Mist quench | 500 | — | — |
| 9 | D | 500 | 0.96 | ○ | 700 | 4% | −25 | 800 | 60 | Water | >1000 | 160 | 150 |
| 10 | E | 500 | 1.10 | ○ | 800 | 8% | −30 | 750 | 120 | Gas | 60 | — | — |
| 11 | F | 500 | 1.15 | ○ | 760 | 9% | −33 | 850 | 30 | Mist quench | 500 | 270 | 270 |
| 12 | F | 500 | 1.10 | ○ | 650 | 9% | −33 | 850 | 30 | Mist quench | 300 | 260 | 510 |
| 13 | A | 500 | 1.00 | ○ | 700 | 5% | −25 | 860 | 160 | Water | >1000 | — | — |
| 14 | B | 500 | 0.95 | ○ | 780 | 6% | −30 | 830 | 110 | Water | >1000 | 300 | 740 |
| 15 | C | 500 | 1.25 | ○ | 700 | 0% | −33 | 860 | 80 | Water | >1000 | 150 | 160 |
| 16 | C | 500 | 1.00 | ○ | 700 | 7% | −38 | 820 | 20 | Gas | 30 | — | — |

| | | Mechanical properties | | | | | None covered area ratio | |
|---|---|---|---|---|---|---|---|---|
| No. | Pickling | YS (MPa) | TS (MPa) | EI % | TS × EI (Mpa · %) | Δ TS (MPa) | of phosphate layer | |
| 1 | Hydrochloric acid | 810 | 1010 | 19.3 | 19520 | 40 | ○ | Inventive |
| 2 | Sulfuric acid | 830 | 1030 | 19.2 | 19820 | 40 | ○ | Inventive |
| 3 | Sulfuric acid | 820 | 1020 | 18.0 | 18350 | 40 | ◎ | Inventive |

TABLE 3-continued

| | | | | | | | | |
|---|---|---|---|---|---|---|---|---|
| 4 | Sulfuric acid | 790 | 990 | 20.1 | 19920 | 10 | X | Comparative |
| 5 | Sulfuric acid | 820 | 1020 | 19.0 | 19350 | 20 | X | Comparative |
| 6 | Sulfuric acid | 810 | 1010 | 18.3 | 18470 | 40 | X | Comparative |
| 7 | — | 660 | 830 | 22.8 | 18960 | 10 | ◎ | Inventive |
| 8 | Hydrochloric acid | 980 | 1230 | 15.5 | 19030 | 30 | ○ | Inventive |
| 9 | Hydrochloric acid | 650 | 810 | 23.7 | 19190 | 40 | ○ | Inventive |
| 10 | Hydrochloric acid | 1070 | 1340 | 14.9 | 19920 | 10 | ◎ | Inventive |
| 11 | — | 700 | 880 | 21.8 | 19190 | 0 | ◎ | Inventive |
| 12 | Sulfuric acid | 740 | 920 | 19.6 | 18050 | 10 | X | Comparative |
| 13 | — | 800 | 1000 | 18.8 | 18760 | 30 | ○ | Inventive |
| 14 | Sulfuric acid | 680 | 850 | 22.2 | 18910 | 30 | ◎ | Inventive |
| 15 | Hydrochloric acid | 1000 | 1250 | 15.2 | 19020 | 0 | X | Comparative |
| 16 | Hydrochloric acid | 430 | 490 | 42.0 | 20580 | 30 | ○ | Comparative |

The steel sheets obtained in the inventive examples achieved a tensile strength (TS) of not less than 590 MPa and excellent processability with TS×El>18000 MPa·%, and showed good phosphatability. The steel sheets in the comparative examples were inferior in any of tensile strength, processability and phosphatability.

EXAMPLE 3

The steels A to F, I, M and N that had the chemical compositions shown in Table 1 were each hot rolled, pickled and cold rolled by ordinary methods to give steel sheets 1.5 mm in thickness. The steel sheets were each annealed by being passed through a continuous annealing line which had a preheating furnace, a heating furnace equipped with direct flame burners, a radiant tube type soaking furnace and a cooling furnace, thereby manufacturing high strength cold rolled steel sheets. The heating furnace equipped with direct flame burners was composed of 4 zones. Carbon gas was used as the fuel in the direct flame burners, and the air ratio in the former stage (zones 1 to 3) and that in the latter stage (zone 4) in the heating furnace were changed to various values. The direct flame burners come to function as oxidizing burners at an air ratio of 0.95 or more. Table 4 describes the conditions in the heating furnace and those in the soaking furnace. After the soak-annealing, the steel sheet was cooled to not more than 100° C. by means of water, mist quench or gas at a cooling rate shown in Table 4. The holding temperature and the holding time described in Table 4 indicate that the steel sheet cooled to not more than 100° C. was reheated to the holding temperature and held for the time described in Table 4. Further, the steel sheets were pickled with the acid described in Table 4 or were directly obtained as products.

The pickling conditions were the same as those described in EXAMPLE 1.

The high strength cold rolled steel sheets were evaluated with respect to mechanical properties and phosphatability. The methods for the evaluation of mechanical properties and phosphatability were the same as those described in EXAMPLE 1.

Table 4 shows the steels used in this EXAMPLE, the manufacturing conditions in the continuous annealing line and the evaluation results.

TABLE 4

| | | | Heating with furnace having direct flame burners | | | | Conditions in reducing atmosphere annealing, cooling and reheating | | | | |
|---|---|---|---|---|---|---|---|---|---|---|---|
| | | Finish preheating | First stage direct flame burners | | Latter stage direct | Temperature | Hydrogen | | Soaking | Soaking | |
| No. | Steel symbol | temperature (° C.) | Air ratio | Oxidizing burners | flame burners Air ratio | on furnace exit side (° C.) | concentration (% by volume) | Dew point (° C.) | temperature (° C.) | time (sec) | Cooling conditions |
| 1 | A | 500 | 1.00 | ○ | 0.82 | 750 | 6% | −28 | 890 | 30 | Water |
| 2 | A | 550 | 0.95 | ○ | 0.82 | 750 | 1% | −35 | 860 | 30 | Water |
| 3 | A | 500 | 1.25 | ○ | 0.82 | 760 | 3% | −40 | 830 | 540 | Water |
| 4 | A | 200 | 1.00 | ○ | 0.82 | 470 | 6% | −42 | 830 | 30 | Water |
| 5 | A | 500 | 0.82 | X | 0.82 | 750 | 6% | −45 | 830 | 30 | Water |
| 6 | B | 500 | 1.20 | ○ | 0.89 | 780 | 10% | −45 | 830 | 30 | Gas |
| 7 | C | 500 | 1.00 | ○ | 0.75 | 750 | 7% | −38 | 820 | 20 | Mist quench |
| 8 | D | 500 | 0.96 | ○ | 0.85 | 750 | 4% | −25 | 800 | 60 | Water |
| 9 | E | 500 | 1.10 | ○ | 0.85 | 800 | 8% | −30 | 750 | 120 | Gas |
| 10 | F | 500 | 1.10 | ○ | 0.85 | 800 | 8% | −30 | 850 | 30 | Mist quench |
| 11 | F | 500 | 1.10 | ○ | 0.85 | 680 | 8% | −30 | 850 | 30 | Mist quench |
| 12 | I | 500 | 0.95 | ○ | 0.75 | 750 | 5% | −30 | 860 | 150 | Water |
| 13 | M | 500 | 1.10 | ○ | 0.85 | 800 | 4% | −35 | 810 | 80 | Water |
| 14 | A | 500 | 0.96 | ○ | 0.75 | 750 | 0% | −30 | 850 | 130 | Water |
| 15 | C | 580 | 1.10 | ○ | 0.85 | 800 | 6% | −32 | 770 | 60 | Water |

TABLE 4-continued

| | | | | | | | | | | | |
|---|---|---|---|---|---|---|---|---|---|---|---|
| 16 | D | 550 | 0.95 | ○ | 0.82 | 750 | 5% | −50 | 830 | 30 | Water |
| 17 | N | 500 | 1.25 | ○ | 0.82 | 760 | 5% | −50 | 830 | 30 | Water |
| 18 | E | 500 | 1.10 | ○ | 0.82 | 760 | 5% | −40 | 850 | 60 | Gas |

| | Conditions in reducing atmosphere annealing, cooling and reheating | | | | Mechanical properties | | | | | | |
|---|---|---|---|---|---|---|---|---|---|---|---|
| No. | Cooling rate (° C./sec) | Holding temperature (° C.) | Holding time (sec) | Pickling | YS (MPa) | TS (MPa) | EI % | TS × EI (Mpa · %) | Δ TS (MPa) | None covered area ratio of phosphate layer | |
| 1 | >1000 | — | — | Hydrochloric acid | 840 | 1050 | 19.0 | 19920 | 40 | ○ | Inventive |
| 2 | >1000 | — | — | Sulfuric acid | 820 | 1030 | 18.8 | 19350 | 40 | ○ | Inventive |
| 3 | >1000 | 210 | 370 | Hydrochloric acid | 800 | 1000 | 18.5 | 18470 | 10 | ◎ | Inventive |
| 4 | >1000 | 210 | 350 | Sulfuric acid | 830 | 1040 | 18.2 | 18960 | 20 | X | Comparative |
| 5 | >1000 | 360 | 610 | Hydrochloric acid | 820 | 1020 | 18.7 | 19030 | 40 | X | Comparative |
| 6 | 100 | — | — | — | 650 | 810 | 23.7 | 19190 | 10 | ◎ | Inventive |
| 7 | 500 | — | — | Hydrochloric acid | 900 | 1120 | 17.8 | 19920 | 30 | ○ | Inventive |
| 8 | >1000 | 270 | 500 | Hydrochloric acid | 550 | 690 | 27.8 | 19190 | 40 | ○ | Inventive |
| 9 | 80 | 310 | 190 | — | 980 | 1230 | 14.7 | 18050 | 10 | ◎ | Inventive |
| 10 | 500 | — | — | Hydrochloric acid | 560 | 700 | 26.8 | 18760 | 0 | ◎ | Inventive |
| 11 | 300 | 200 | 810 | — | 640 | 800 | 23.6 | 18910 | 10 | X | Comparative |
| 12 | >1000 | 270 | 200 | Hydrochloric acid | 750 | 940 | 17.4 | 16310 | 30 | ○ | Comparative |
| 13 | >1000 | — | — | Sulfuric acid | 1040 | 1300 | 8.5 | 11050 | 20 | ◎ | Comparative |
| 14 | >1000 | 270 | 880 | Hydrochioric acid | 800 | 1000 | 19.0 | 18960 | 40 | X | Comparative |
| 15 | >1000 | 180 | 510 | Hydrochloric acid | 920 | 1150 | 16.7 | 19190 | 30 | X | Comparative |
| 16 | >1000 | 380 | 810 | — | 600 | 750 | 26.6 | 19920 | 40 | ○ | Inventive |
| 17 | >1000 | 190 | 500 | Hydrochloric acid | 750 | 1150 | 16.7 | 19190 | 110 | ◎ | Inventive |
| 18 | 40 | — | — | — | 750 | 950 | 15.6 | 14820 | 20 | ○ | Comparative |

The steel sheets obtained in the inventive examples achieved a tensile strength (TS) of not less than 590 MPa and excellent processability with TS×El>18000 MPa·%, and showed good phosphatability. The steel sheets in the comparative examples were inferior in any of tensile strength, processability and phosphatability.

INDUSTRIAL APPLICABILITY

The methods according to the present invention can be used for the manufacturing of high-Si, high strength cold rolled steel sheets of excellent phosphatability that have a tensile strength of not less than 590 MPa and excellent processability with TS×El being not less than 18000 MPa·%.

The invention claimed is:

1. A method for the manufacturing of high strength cold rolled steel sheets of excellent phosphatability, comprising continuously annealing a cold rolled steel sheet that has a composition containing:

C: 0.05 to 0.3% by mass,

Si: 0.6 to 3.0% by mass,

Mn: 1.0 to 3.0% by mass,

P: not more than 0.1% by mass,

S: not more than 0.02% by mass,

Al: 0.01 to 1% by mass,

N: not more than 0.01% by mass, and

Fe and inevitable impurities: balance, in a manner such that the cold rolled steel sheet is heated in a furnace using an oxidizing burner to a steel sheet temperature of not less than 700° C., thereafter the steel sheet is soak-annealed in a reducing atmosphere furnace at 750 to 900° C., and the steel sheet is cooled in a manner such that the average cooling rate between 500° C. and 100° C. is not less than 50° C./s.

2. A method for the manufacturing of high strength cold rolled steel sheets of excellent phosphatability, comprising continuously annealing a cold rolled steel sheet that has a composition containing:

C: 0.05 to 0.3% by mass,

Si: 0.6 to 3.0% by mass,

Mn: 1.0 to 3.0% by mass,

P: not more than 0.1% by mass,

S: not more than 0.02% by mass,

Al: 0.01 to 1% by mass,

N: not more than 0.01% by mass, and

Fe and inevitable impurities: balance, in a manner such that the cold rolled steel sheet is heated to a steel sheet temperature of not less than 700° C. in a manner such that the steel sheet is heated in a furnace using an oxidizing burner at least when the steel sheet temperature is elevated from 600° C. to 700° C., thereafter the steel sheet is soak-annealed in a reducing atmosphere furnace at 750 to 900° C., and the steel sheet is cooled in a manner such that the average cooling rate between 500° C. and 100° C. is not less than 50° C./s.

3. A method for the manufacturing of high strength cold rolled steel sheets of excellent phosphatability, comprising continuously annealing a cold rolled steel sheet that has a composition containing:

C: 0.05 to 0.3% by mass,
Si: 0.6 to 3.0% by mass,
Mn: 1.0 to 3.0% by mass,
P: not more than 0.1% by mass,
S: not more than 0.02% by mass,
Al: 0.01 to 1% by mass,
N: not more than 0.01% by mass, and
Fe and inevitable impurities: balance,
in a manner such that the cold rolled steel sheet is heated in a manner such that the steel sheet is heated in a furnace using an oxidizing burner at least from before the steel sheet temperature reaches 550° C. and further heated to a steel sheet temperature of not less than 750° C. in a furnace using a direct flame burner that is located after the oxidizing burner and has an air ratio of not more than 0.89, thereafter the steel sheet is soak-annealed in a reducing atmosphere furnace at 750 to 900° C., and the steel sheet is cooled in a manner such that the average cooling rate between 500° C. and 100° C. is not less than 50° C./s.

4. The method for the manufacturing of high strength cold rolled steel sheets of excellent phosphatability according to claim 1, wherein the steel sheet further contains one or two or more of:
Ti: 0.001 to 0.1% by mass,
Nb: 0.001 to 0.1% by mass, and
V: 0.001 to 0.1% by mass.

5. The method for the manufacturing of high strength cold rolled steel sheets of excellent phosphatability according to claim 1, wherein the steel sheet further contains one or two of:
Mo: 0.01 to 0.5% by mass, and
Cr: 0.01 to 1% by mass.

6. The method for the manufacturing of high strength cold rolled steel sheets of excellent phosphatability according to claim 1, wherein the steel sheet further contains:
B: 0.0001 to 0.003% by mass.

7. The method for the manufacturing of high strength cold rolled steel sheets of excellent phosphatability according to claim 1, wherein the steel sheet further contains one or two of:
Cu: 0.01 to 0.5% by mass, and
Ni: 0.01 to 0.5% by mass.

8. The method for the manufacturing of high strength cold rolled steel sheets of excellent phosphatability according to claim 1, wherein after the cooling step, the steel sheet is reheated to 150 to 450° C. and soak-heat treated at the temperature for 1 to 30 minutes.

9. The method for the manufacturing of high strength cold rolled steel sheets of excellent phosphatability according to claim 2, wherein the steel sheet further contains one or two or more of:
Ti: 0.001 to 0.1% by mass,
Nb: 0.001 to 0.1% by mass, and
V: 0.001 to 0.1% by mass.

10. The method for the manufacturing of high strength cold rolled steel sheets of excellent phosphatability according to claim 3, wherein the steel sheet further contains one or two or more of:
Ti: 0.001 to 0.1% by mass,
Nb: 0.001 to 0.1% by mass, and
V: 0.001 to 0.1% by mass.

11. The method for the manufacturing of high strength cold rolled steel sheets of excellent phosphatability according to claim 2, wherein the steel sheet further contains one or two of:
Mo: 0.01 to 0.5% by mass, and
Cr: 0.01 to 1% by mass.

12. The method for the manufacturing of high strength cold rolled steel sheets of excellent phosphatability according to claim 3, wherein the steel sheet further contains one or two of:
Mo: 0.01 to 0.5% by mass, and
Cr: 0.01 to 1% by mass.

13. The method for the manufacturing of high strength cold rolled steel sheets of excellent phosphatability according to claim 4, wherein the steel sheet further contains one or two of:
Mo: 0.01 to 0.5% by mass, and
Cr: 0.01 to 1% by mass.

14. The method for the manufacturing of high strength cold rolled steel sheets of excellent phosphatability according to claim 2, wherein the steel sheet further contains:
B: 0.0001 to 0.003% by mass.

15. The method for the manufacturing of high strength cold rolled steel sheets of excellent phosphatability according to claim 3, wherein the steel sheet further contains:
B: 0.0001 to 0.003% by mass.

16. The method for the manufacturing of high strength cold rolled steel sheets of excellent phosphatability according to claim 4, wherein the steel sheet further contains:
B: 0.0001 to 0.003% by mass.

17. The method for the manufacturing of high strength cold rolled steel sheets of excellent phosphatability according to claim 5, wherein the steel sheet further contains:
B: 0.0001 to 0.003% by mass.

18. The method for the manufacturing of high strength cold rolled steel sheets of excellent phosphatability according to claim 2, wherein the steel sheet further contains one or two of:
Cu: 0.01 to 0.5% by mass, and
Ni: 0.01 to 0.5% by mass.

19. The method for the manufacturing of high strength cold rolled steel sheets of excellent phosphatability according to claim 3, wherein the steel sheet further contains one or two of:
Cu: 0.01 to 0.5% by mass, and
Ni: 0.01 to 0.5% by mass.

20. The method for the manufacturing of high strength cold rolled steel sheets of excellent phosphatability according to claim 4, wherein the steel sheet further contains one or two of:
Cu: 0.01 to 0.5% by mass, and
Ni: 0.01 to 0.5% by mass.

* * * * *

UNITED STATES PATENT AND TRADEMARK OFFICE

CERTIFICATE OF CORRECTION

PATENT NO. : 8,668,789 B2
APPLICATION NO. : 13/387761
DATED : March 11, 2014
INVENTOR(S) : Hirasawa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 228 days.

Signed and Sealed this
Twenty-ninth Day of September, 2015

Michelle K. Lee

Michelle K. Lee
*Director of the United States Patent and Trademark Office*